United States Patent [19]

Eckler

[11] Patent Number: 4,743,018

[45] Date of Patent: May 10, 1988

[54] OFFSET ROTATABLE HANDLE MEMBERS FOR EXERCISING APPARATUS

[76] Inventor: Christopher W. Eckler, P.O. Box 564, Nashua, N.H. 03061

[21] Appl. No.: 915,371

[22] Filed: Oct. 3, 1986

[51] Int. Cl.[4] ..... A63B 13/00

[52] U.S. Cl. ..... 272/123; 272/143

[58] Field of Search ..... 272/123, 143, 116, 117, 272/122, DIG. 4, 93

[56] References Cited

U.S. PATENT DOCUMENTS

| | | | |
|---|---|---|---|
| 1,333,005 | 3/1920 | Warner | 272/143 X |
| 3,384,370 | 5/1968 | Bailey et al. | 272/123 |
| 3,904,198 | 9/1975 | Jones | 272/123 |
| 4,312,506 | 1/1982 | Brennan | 272/123 |
| 4,461,473 | 7/1984 | Cole | 272/123 |
| 4,585,229 | 4/1986 | Brasher | 272/123 |
| 4,618,143 | 10/1986 | Twardosz | 272/123 |
| 4,629,184 | 12/1986 | Selkee | 272/123 |

*Primary Examiner*—William F. Pate, III
*Assistant Examiner*—Richard E. Chilcot, Jr.
*Attorney, Agent, or Firm*—Richard C. Litman

[57] ABSTRACT

An offset rotatable handle member and exercising apparatus consisting of a crosspiece of fixed length between its ends and being hollow throughout its length and having a cross section formed by several orthogonal sides, a cable attaching member about the center of the crosspiece and extending from one of the several orthogonal sides, handle hangar members securably attached from one opposite side of the several orthogonal sides of the weight, attachably supporting weights for use in exercising, and a hand grasping member in the handle hangar for providing a rotatable hand grip for weightlifting apparatus so the hands can be rotated while supporting the weightlifting apparatus with the capability to change hand positions from pronated to all the way to supinated in one movement without having to drop the bar and regrip it.

4 Claims, 2 Drawing Sheets

OFFSET ROTATABLE HANDLE MEMBERS FOR EXERCISING APPARATUS

BACKGROUND OF THE INVENTION

1. Field of the Invention

The invention relates to improved offset rotatable handle members and exercising apparatus, and more particularly the invention is directed to an improved offset rotatable handle member and exercising apparatus consisting of a crosspiece of fixed length between its ends and being hollow throughout its length an having a cross section formed by several orthogonal sides, a cable attaching member about the center of the crosspiece and extending from one of the several orthogonal sides, handle hangar members securably attached from one opposite side of the several orthogonal sides of the weight, attachably supporting weights for use in exercising, and a hand grasping member in the handle hangar for providing a rotatable hand grip for weightlifting apparatus so the hands can be rotated while supporting the weightlifting apparatus with the capability to change hand positions from pronated all the way to supinated in one movement without having to drop the bar and regrip it.

2. Description of the Prior Art

Various prior art rotatable handle grip devices and associated or related components for exerciser equipment and the like, as well as apparatus and method of their construction in general, are found to be known and exemplary of the U.S. prior art are the following:

| | |
|---|---|
| 1,333,005 | H. J. Warner |
| 2,819,081 | J. Touraine |
| 3,384,370 | E. Bailey et al |
| 4,461,473 | J. W. Cole |
| CAM STAR ® 2035 Bilateral Arm Curl | Manufactured by Hogan Health Equipment, Salt Lake City, Utah, U.S.A. |
| ROTO-BAR ® (patent pending) | Manufactured by Exerquip[ment, Oak Brook Illinois, U.S.A. |

These patents together with the printed material on the ROTO-BAR ® equipment disclose a rotatable hand grip for lifting apparatus so the hands can be rotated while supporting the lifting apparatus with the capability to change hand positions from pronated (palms down) all the way to supinated (palms up) all in one movement without having to drop the bar and regrip it and the Cole patent discloses the use of roller bearings. The CAM STAR ® equipment material discloses a rotatable hand grip for weightlifting machines so the hands can be rotated while working the weightlifting machine.

These patents or known prior uses teach and disclose various types of rotatable handle grip devices associated or related to exerciser equipment devices of sorts and of various manufactures and the like as well as methods of their construction, but none of them whether taken singly or in combination disclose the specific details of the combination of the invention in such a way as to bear upon the claims of the present invention.

SUMMARY OF THE INVENTION

An object, advantage and feature of the invention is to provide a novel device that practically eliminates joint strain, a problem for many lifters, because the hand grips are mounted in ball bearings and are free to rotate during exercises; this provides natural wrist rotation, and together with the shape of the bar, allows a more comfortable grip plus a range of motion not possible with conventional free weight systems and many weight machines; and further results in superior muscle development with less work. The width of the bar is adjustable and includes two crosspieces and a cable attachment to fit suitable for the person, rack or cable equipment.

Another object of the invention is directed further to a device providing for adjustable distances between handle grips in combination with the rotatable handles of the present invention.

Also an object of the invention is to provide a simple and direct method for the improved construction of offset rotatable handle members for exercising apparatus that reduces joint strain and improves the range of motion thereof resulting in more flexibility, shorter workouts and greater gains.

Another object of the invention is to provide an apparatus that has adjustable width combined with an offset crosspiece and yet allows more exercises to be performed.

Another object of the invention is to provide an apparatus that has a crosspiece that is offset in two directions so that all of the exercises can be performed advantageously.

Another object of the invention is to provide an apparatus that has rotatable grips in combination with an offset crosspiece and with adjustable widths between the grips.

Another object of the invention is to provide an exercise apparatus that has rotatable handles in combination with a crosspiece connected to the handles offset in two directions, such as downwardly and rearwardly, for example, and further provided with an adjustable width between the handles.

Another object of the invention is to provide an exerciser apparatus that has the capability of supplying resistance via a cable attached to remote weights rather than having to add free weights directly on to the exerciser apparatus.

Another object of the invention is to provide an exerciser apparatus that includes an overall design in the use of ball bearings rather than rollers and allows use of much heavier weights on any exercise; rollers can only take forces in certain directions while balls are indifferent to the direction of the applied forces; rollers limit the use of certain exercises where the majority of the load is directed radially against the rollers or where very little weight is used as in bicep curls and tricep extensions; only one of these exercises could be performed if the width of the crosspiece could not be changed.

Another object of the invention is to provide an apparatus that allows a greater range of motion with less joint stress for most freeweight exercises; freedom of motion is achieved by mounting the handles on ball bearings allowing them to rotate along the axis of the arm and preventing any unnatural motion of the joints and this freedom to rotate together with the adjustability of the distance between the handles and the unique shape of the apparatus allowing the exercises to be performed through a superior range of motion, thus enhancing flexibility and strength more than with any other exerciser equipment.

These together with other objects and advantages which will become subsequently apparent reside in the details of the process and operation thereof as more fully hereinafter is described and claimed, reference being had to the accompanying drawings forming a part hereof, wherein like numerals refer to like parts throughout.

DESCRIPTION OF A PREFERRED EMBODIMENT OF THE INVENTION

Figure 1:
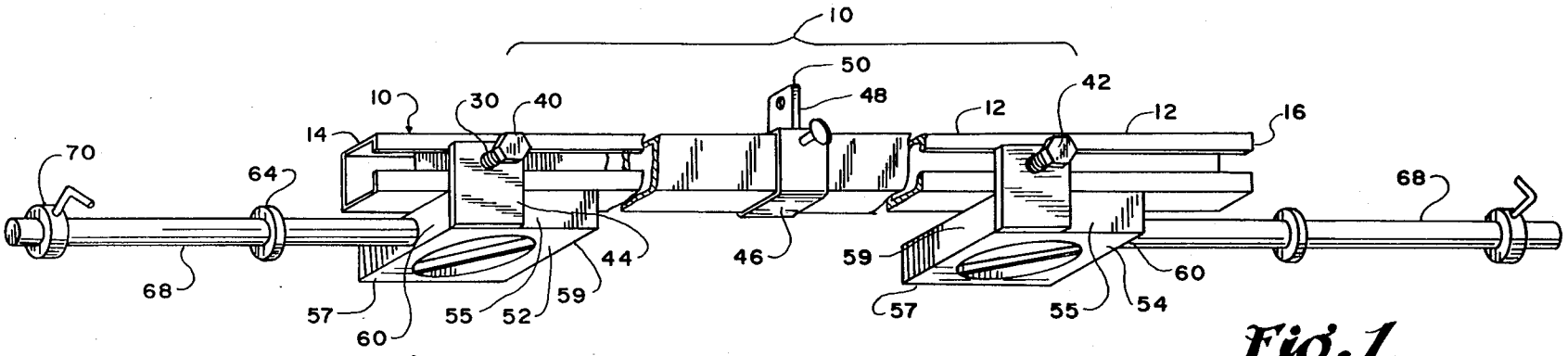
FIG. 1 is an exploded perspective view of a cable exercise apparatus and illustrating a typical installation of the apparatus according to a preferred embodiment and best mode of the present invention.
Figure 2:
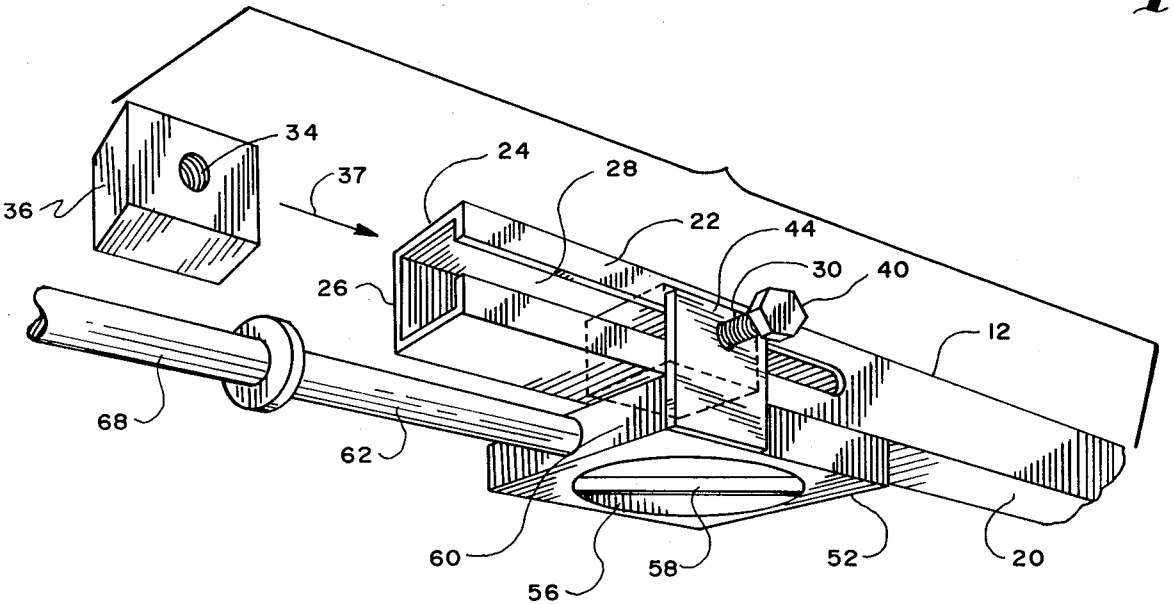
FIG. 2 is an enlarged exploded perspective view of details for attaching the rotatable handle members to the crosspiece.

Referring now to the drawings there is shown in FIGS. 1 and 2 an offset rotatable handle member and exercising apparatus 10 of metal consisting of a crosspiece 12 of any fixed length between ends 14,16 and being hollow throughout the length and formed so the exterior and interior cross sections, as shown in FIG. 2, are of orthogonal sides 20, 22, 24, 26. The crosspiece 12 is constructed of strong metal material for carrying heavy loads for weightlifting apparatus and equipment.

As shown more particularly in FIG. 2 the side 22 has a slot or passway 28 of constant thickness and opening as a means for allowing a bolt 30 with its threaded portion 32 to mutually engage a threaded portion 34 internally disposed within a nut or bolt-receiving-member 36, which may be cursorily identified as a member 36. It should be noted that the bolt may not go entirely through the slot in the crosspiece and the threads of the bolt mate with the tapped hole in the angle iron 44 or clamp so that the crosspiece is pinched between the bolt and the blocks welded to the angle when the bolt is tightened. The nut 36 is so configured that it is inserted in the hollow of the crosspiece 12 in the direction shown by the arrow 37 and may fill its adjacent hollow portion within the crosspiece 12 sufficient that the nut member 36 does not turn about the axis of the bolt 30 when it is rotated by manually turning of the bolt heads 40, 42 used to tighten or loosen it. This arrangement is inserted from each of the ends 14, 16 and is clear by showing bolt heads 40, 42 in FIG. 1. In this fashion the bolt 30 securably attaches the clamp or plate 44 to the crosspiece 12.

At a mid-point 46 of the crosspiece 12 is affixed a cable attaching member 48 having an eye or aperture 50 for receiving a hook or other cable connector (not shown). The cable attaching member 48 is essentially a hollow frame configured to slide along the crosspiece 12 and retained in place by friction applied by a screw or other biasing device to secure the cable attaching member 48 on the crosspiece 12. Markings may be shown along the crosspiece 12 to indicate its mid-portion and to indicate also relative selective portions for locating each plate 44. For securably attaching from orthogonal sides 20, 22, 24, 26 of the crosspiece 12, the plate 44 supports by a weld joint or the like a hangar 52, 54 configured as a square member having at a central portion a circular aperture 56 for receiving a hand grasping member or handle 58 mounted in ball bearing relation in the handle hangar 52, 54 for providing a rotatable hand grip for weightlifting apparatus so the hands can be rotated while supporting the weightlifting apparatus with the capability to change hand positions from pronated all the way to supinated in one movement without having to drop the bar and regrip it. Each hanger 52,54 includes a front wall 55, opposite rear wall 57, inside wall 59 and outside wall 60. As shown in FIG. 1 there is extending outwardly from side 60 of the handle hangar 52, 54 a bar 68 including a spacer 64 and terminating in a stub bar for carrying weights. A ring 70 is adapted to fit and be securably attached to the stub bar 68 for retaining weights on the stub bar 68. By means of this construction the weights on the stub bar 68 are offset from the axis of the crosspiece 12 while remaining in line with the center of gravity of the handle and the widths between the hand grasping members 58 are each selectively adjustable by slidable adjustment of the plate 44 and securing the bolt 30 by turning bolt head 40.

Figure 3:
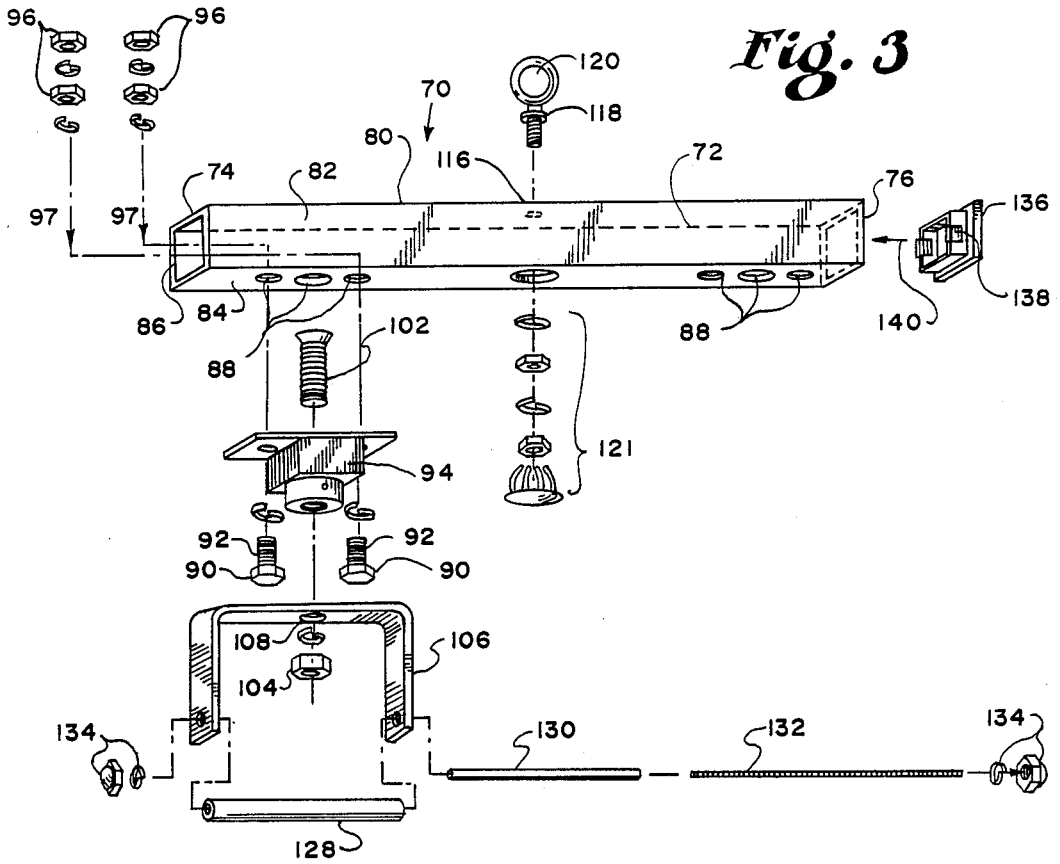
FIG. 3 is an exploded perspective view of a smaller cable exerciser apparatus.

FIG. 3 shows an offset rotatable handle member and exercising apparatus 70 of metal consisting of a short and non-adjustable crosspiece 72 of any short fixed length between ends 74,76 and being hollow throughout the length and formed so the exterior and interior cross sections are of orthogonal sides 80, 82, 84, 86. The crosspiece 72 is constructed of strong metal material for carrying heavy loads usual for weightlifting apparatus and equipment.

As shown more particularly in FIG. 3 the side 84 has apertures 88 of constant thickness and opening as a means for allowing a bolt 90 with its threaded portion 92 to mutually engage a threaded portion internally disposed within nut members 96. The nut members 96 are so configured that they are inserted in the hollow 88 of the crosspiece 72 in the direction shown by the arrow 97 and may fill its adjacent hollow portion within the crosspiece 72 sufficient that the nut members 96 do not turn about the axis of the bolt 90 when it is rotated by manually turning of the bolt heads 90 used to tighten or loosen it. This arrangement is inserted from each of the ends 74,76 and is clear by showing the bolt heads 90,92 in FIG. 3. In this fashion the bolt 90 securably attaches a pivot member 94 to the crosspiece 12. The pivot member 94 utilizes a pivot bolt 102 and nut 104 so a U-shaped hangar 106 may rotate about its center 108.

At a mid-point 116 of the crosspiece 72 is affixed a cable attaching member 118 having an eye or aperture 120 for receiving a hook or other cable connector (not shown). The cable attaching member 118 is essentially a hollow frame configured for insertion in the crosspiece 72 and retained in place by friction applied by a screw and nut assembly 121 or other biassing device to secure the cable attaching member 118 on the crosspiece 72. For securably attaching from orthogonal sides 80, 82, 84, 86 of the crosspiece 72, both of the set of two hangars 106 is U-configured for receiving a hand grasping member 128 mounted in the handle hangars 106 for providing a rotatable hand grip for weightlifting apparatus so the hands can be rotated while supporting the weightlifting apparatus with the capability to change hand positions from pronated all the way to supinated in one movement without having to drop the bar and regrip it. One feature of the invention contemplates that a bar stub for carrying weights may extend outwardly from a side (not shown) of the handle hangars 106 and the handles are so constructed and arranged that they are always offset from the crosspiece to provide a shape which can improve a range of motion. However the weights do not necessarily have to be offset from the crosspiece and they can be offset from the handles. For instance, in the cable bar, the resistance is applied directly to the crosspiece which is offset from the handles. If freeweights were added directly to the cable exerciser, they would be attached to the crosspiece rather than U-shaped hangars. If they were added directly onto the straight crosspiece as it exists now, however, it would limit hand retractable spring plungers as well as the number of exercises that could be performed as shown in the drawings as described. A ring is adapted to fit and be securably attached to the stub bar for retaining weights on the stub bar. By means of this construction the weights on the stub bar 68 are offset from the axis of the crosspiece 12 and the widths of the hand grasping member 58 are selectively adjustable by slidable adjustment of the plate and securing the bolt by turning the bolt head; the cable exercisers may use hand retractable spring plungers. The hand grasping member 128 is shown having a roller bar 130 pivotally supported by a threaded support 132 having end washers and terminating acorn nut members 134. Plastic end caps 136 secured by a plastic abrasive tape 138 are applied in the direction of arrow 140 to each end of the crosspiece 72.

Figure 4:
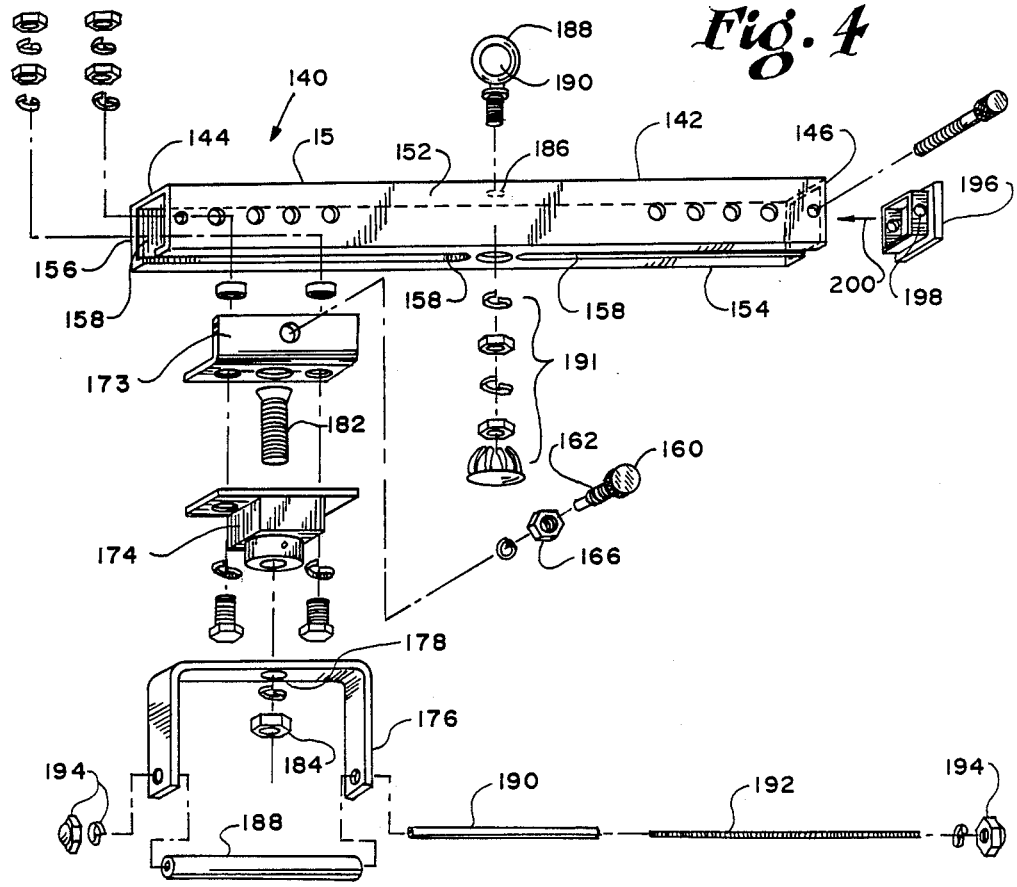
FIG. 4 is an exploded perspective view of an intermediate sized, adjustable cable exerciser apparatus, and all embodying the concepts of the invention.

FIG. 4 shows an offset rotatable handle member and exercising apparatus 140 of plastic or metal consisting of a long and adjustable crosspiece 142 of any long fixed length between ends 144, 146 and being hollow throughout the length and formed so the exterior and interior cross sections are of orthogonal sides 150, 152, 154, 156. The crosspiece 142 is constructed preferably of any strong metal material for carrying heavy loads usual for weightlifting apparatus and equipment.

As shown more particularly in FIG. 4 the side 154 has apertures 156 of constant thickness and opening as a means for allowing a bolt means or hand handretractable spring plunger 160 with its threaded portion 162 to mutually engage a threaded portion internally disposed within nut members 166. The plunger 160 can be pulled and released into any of the holes in the front of the crosspiece to set the width between handles. The nut members 166 may be so configured that they can be inserted in the hollow 158 of the crosspiece 142 in the direction shown by the arrow 167 and may fill its adjacent hollow portion within the crosspiece 142 sufficient that the nut members 166 do not turn about the axis of the plunger 160 when it is rotated by manually turning of the bolt heads 160 used to tighten or loosen it. This arrangement is inserted from each of the ends 144, 146 and is clear by showing the plunger 160 in FIG. 4. In this fashion the plunger 160 securably attaches a flush-mount flange bearing or pivot member 174 to the crosspiece 142. The pivot member 174 utilizes a pivot bolt 182 and nut 184 so U-shaped hangar 176 may rotate about its center 178.

At a mid-point 186 of the crosspiece 142 is affixed a cable attaching member 188 having an eye or aperture 190 for receiving a hook or other cable connector (not shown). The cable attaching member 188 is essentially a hollow eyebolt configured for insertion in the crosspiece 142 and retained in place by friction applied by a screw and nut assembly 191 or other biassing device to secure the cable attaching member 188 on the crosspiece 142. For securably attaching from orthogonal sides 150, 152, 154, 156 of the crosspiece 142, both of the set of two hangars 176 is U-configured for receiving a hand grasping member 188 mounted in the handle hangars 176 for providing a rotatable hand grip for weightlifting apparatus so the hands can be rotated while supporting the weightlifting apparatus with the capability to change hand positions from pronated to all the way to supinated in one movement without having to drop the bar and regrip it. Extending outwardly from a side (not shown) of the handle hangars 176, or ends 146, 150 may be bar stubs for carrying weights. A ring is adapted to fit and be securably attached to the stub bar for retaining weights on the stub bar. By means of this construction the weights on the stub bar are offset from the axis of the crosspiece 142 and the widths of the hand grasping member 188 are selectvely adjustable by slidable adjustment of the plate and angle iron for securing by use of the spring plunger 160. The hand grasping member 188 is shown having a roller bar 190 pivotally supported by a threaded support 192 having end washers and terminating acorn nut members 194. Plastic end caps 196 may be variously secured by means such as bolts, a ball-and-detent or an aperture 198 for receiving the bolts, and are applied in the direction of arrow 200 indicating where the bolts should go into each end of the crosspiece 142.

The apparatus of the offset rotatable handle member and exercising apparatus 10, 70, 140 of the invention may be so constructed and arranged in its component parts that it may be assembled as a kit or in kit form.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed and desired to be secured by Letters Patent is:

1. An exercising apparatus comprising;

a crosspiece of fixed length having a pair of opposite ends and provided with a plurality of sides defining a rectangular cross-section having a central cavity, cable attaching means on the medial portion of said crosspiece, a pair of handle hanger members each disposed on opposite sides of said cable attaching means, each said handle hanger member having a central aperture extending through opposite planar faces and bounded by front, rear, inside and outside walls, clamp means carried by each said hanger member affixing one said planar face of each said hanger member to one said side of said cross-piece with said aperture positioned substantially laterally offset from an adjacent one said side of said crosspiece and maintaining said planar faces and the central axis of said aperture fixed relative said cross-piece, a stub bar for supporting weights extending outwardly from said outside wall of each said hanger member and having an axis, if extended, passing through and normal to the center axis of said hanger member apertures whereby, said stub bar axes are substantially laterally offset from said cross-piece and a clearance space is provided between said inside walls of said hanger members laterally of said cross-piece and, hand gripping means mounted in each said hanger member aperture providing a rotatable hand grip for weightlifting whereby, the hands can be rotated while supporting the apparatus with the capability to change hand positions from pronated all the way to supinated in one movement without having to release and regrip said hand gripping means.

2. An exercising apparatus according to claim 1 wherein, said one side of said cross-piece is provided with a longitudinal slot, a pair of fastener-receiving members slidably disposed within said cross-piece central cavity, and each said clamp means includes a releasable fastener disposed through said slot and engageable with one said fastener-receiving member whereby, manipulation of said fasteners allows the axial displacement of said hanger members with their attached stub bars to vary the axial extent of said clearance space and the distance between said weights carried by said stub bars while maintaining said hanger members in a fixed plane relative said cross-piece.

3. An exercising apparatus according to claim 1 wherein, said cable attaching means includes an eyebolt.

4. An exercising apparatus according to claim 1 wherein, said hand gripping means is mounted through ball bearings to said hanger members.

* * * * *